US008890042B2

(12) United States Patent
Uchida et al.

(10) Patent No.: US 8,890,042 B2
(45) **Date of Patent: *Nov. 18, 2014**

(54) INDUCTION HEATING DEVICE, CONTROL METHOD THEREOF, AND CONTROL PROGRAM THEREOF

(75) Inventors: Naoki Uchida, Okayama (JP); Keiji Kawanaka, Okayama (JP); Takahiro Ao, Okayama (JP)

(73) Assignee: Mitsui Engineering & Shipbuilding Co., Ltd. (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/006,567

(22) PCT Filed: Nov. 2, 2011

(86) PCT No.: PCT/JP2011/075251

§ 371 (c)(1),
(2), (4) Date: Sep. 20, 2013

(87) PCT Pub. No.: WO2012/127730

PCT Pub. Date: Sep. 27, 2012

(65) Prior Publication Data

US 2014/0008356 A1 Jan. 9, 2014

(30) Foreign Application Priority Data

Mar. 23, 2011 (JP) ..... 2011-063528

(51) Int. Cl.

| | |
|---|---|
| ***H05B 6/02*** | (2006.01) |
| ***H05B 6/12*** | (2006.01) |
| ***H05B 6/64*** | (2006.01) |
| ***H05B 6/06*** | (2006.01) |
| ***H05B 6/10*** | (2006.01) |

(52) U.S. Cl.

CPC .. *H05B 6/02* (2013.01); *H05B 6/06* (2013.01); *H05B 6/101* (2013.01)

USPC ..... 219/672; 219/626; 219/662

(58) Field of Classification Search

CPC ..... H05B 6/02; H05B 6/06; H05B 6/104; H05B 6/04; H05B 6/065

USPC ..... 219/672, 626, 625, 662, 663, 675, 664, 219/670; 373/152; 363/131

See application file for complete search history.

(56) References Cited

U.S. PATENT DOCUMENTS 4,549,056 A * 10/1985 Okatsuka et al. ..... 219/626
5,951,904 A * 9/1999 Jung et al. ..... 219/626

(Continued)

FOREIGN PATENT DOCUMENTS

CN 101917788 12/2010
JP 2004-134138 4/2004

(Continued)

OTHER PUBLICATIONS

International Search Report from International Application No. PCT/JP2011/075251 mailed Nov. 29, 2011.

(Continued)

*Primary Examiner* — Quang Van

(74) *Attorney, Agent, or Firm* — Merchant & Gould P.C.

(57) ABSTRACT

The present invention includes: a plurality of induction heating coils (11, 12, 13) which are disposed adjacently; capacitors (21, 22, 23) each of which is connected in series thereto; a plurality of inverters (30, 35, 31) each of which applies a high frequency voltage converted from a DC voltage to each series resonant circuit of the induction heating coil and the capacitor; and a control circuit (50) which operates the plurality of the inverters with a same frequency and current synchronization, controls so that a phase difference becomes minimal at a specific inverter, which supplies the maximum power to the plurality of the induction heating coils, between the high frequency voltage generated therefrom, and a resonant current flowing the series resonant circuit, and set a DC power supply voltage Vdc applied to the plurality of the inverters so that the output voltages (Vinv) become greater than mutual induction voltages (Vm).

10 Claims, 13 Drawing Sheets

(56) References Cited

U.S. PATENT DOCUMENTS

2013/0194851 A1* 8/2013 Shan et al. ..... 363/131
2013/0248520 A1* 9/2013 Uchida et al. ..... 219/662

FOREIGN PATENT DOCUMENTS

JP 2007-328918 12/2007
JP 2010-287447 12/2010

OTHER PUBLICATIONS

Chinese Office Action for corresponding application No. 201180069489.2 mailed May 4, 2014 (7 pages).

* cited by examiner

INDUCTION HEATING DEVICE, CONTROL METHOD THEREOF, AND CONTROL PROGRAM THEREOF

CROSS REFERENCE TO RELATED APPLICATION

This present application is a National Stage Application of PCT Application No. PCT/JP2011/075251 filed on Nov. 2, 2011, which claims benefit of Ser. No. 2011-063528, filed Mar. 23, 2011 in Japan and which applications are incorporated herein by reference. To the extent appropriate, a claim of priority is made to each of the above disclosed applications.

TECHNICAL FIELD

The present invention relates to an induction heating device, provided with inverters for supplying a high frequency power to induction heating coils, a control method thereof, and a control program thereof.

BACKGROUND OF THE INVENTION

Before finishing various products by performing forging, rolling or extrusion against a billet (ingot), it is necessary to soften the billet by heating it, for example, to a settling temperature 1250° C. When an attempt is made to keep a rod-shaped billet at a settling temperature by heating a single coil, as a temperature distribution becomes non-uniform, it often results in a waste caused by a failure that it does not become at a predetermined temperature in a transient time such as during a standby mode and when transitioning from a standby mode to normal heating mode. Further, when an attempt is made to keep both end portions at a settling temperature, the central portion becomes at a high temperature and the furnace itself is sometimes dissolved. Therefore, an induction heating device is used for heating, in which an induction heating coil is divided into multiple coils and a power control is performed by connecting a high-frequency power source (e.g., an inverter) to each of the divided induction heating coils individually.

However, as each of the divided induction heating coils is disposed close to each other in order to prevent a temperature between the induction heating coils from falling, mutual induction inductances M are present, thereby generating mutual induction voltages. Therefore, each of the inverters is operated in parallel via mutual inductance and it may cause a mutual power transfer between the inverters when having a mutual phase shift of electric current between the inverters. In other words, as phase shifts occur in magnetic fields among the divided induction heating coils due to a phase shift of an electric current in each of the inverters, magnetic fields in the vicinity of the boundary of the adjacent induction heating coils are weakened, thereby reducing the density of heat generated by an induction heating power. As a result, temperature variations may occur on the surface of the heated object (such as a billet and a wafer).

Hence, a technique of Zone Controlled Induction Heating (ZCIH) was proposed by inventors and others, with which technique, even under a situation that a mutual inductance M exists between the adjacent induction heating coils and causes a mutual induction voltage, by preventing a circulation current from flowing between the mutual inverters as well as preventing heat density from degrading in the vicinity of the boundary of the divided induction heating coils, it is capable to appropriately control the induction heating power. According to the ZCIH technique, each power supply unit is provided with a step-down chopper and a voltage source inverter (hereinafter referred to simply an inverter). Then, each of the power supply units divided into a plurality of power supply zones is individually connected to each of the induction heating coils, respectively, for supplying power.

In this case, the respective inverters in each of the power supply units are controlled for current synchronization (i.e., synchronization control of a current phase), and by synchronizing phases of currents flowing in the respective inverters, circulation currents are prevented from flowing mutually among the plurality of the inverters. In other words, by suppressing electric currents from flowing mutually among the plurality of the inverters, over-voltages are avoided from occurring by the regenerative electric powers flowing to the inverters. In addition, by synchronizing phases of currents flowing in the respective divided induction heating coils, a heat density by an induction heating power is intended not to be degraded rapidly in the vicinity of the boundary of each of the induction heating coils.

Furthermore, by varying an input DC voltage of each of the inverters, each of the step-down choppers controls the current amplitude of each of the inverters, thereby controlling an induction heating power supplied to each of the induction heating coils. That is, a ZCIH technique disclosed in Japanese Patent Application Publication No. 2010-287447A, by performing current amplitude control for each step-down chopper, controls a power of the induction heating coil in each zone, and by controlling synchronization of current phases of respective inverters, intends to suppress circulating currents mutually among a plurality of the inverters, and homogenizes a density of the heat generated by the induction heating power in the vicinity of the boundary of each of the induction heating coils. By the control system for the step-down chopper and the control system for the inverter performing individual controls using such a ZCIH technique, it is possible to control a heat generation distribution on the object to be heated as desired. That is, it is possible to perform a rapid and precise temperature control and a temperature distribution control, using the ZCIH technique disclosed in Japanese Patent Application Publication No. 2010-287447A.

According to a technique disclosed in Japanese Patent Application Publication No. 2010-287447A, a current resonance inverter is configured by connecting a resonant capacitor in series with a heating coil, then a single converter (chopper) is connected to a plurality of the resonance inverters as a power source for supplying a DC power thereto, wherein, by varying a power supply voltage applied commonly to the plurality of the resonance inverters and increasing a phase difference between the rising timing of the rectangular wave voltage and the zero-cross timing of the resonant current, an inverter circuit realizes a ZVS (Zero Voltage Switching) and reduces a recovery loss at a commutation diode.

Further, a technique is disclosed in Japanese Patent Application Publication No. 2004-134138A for supplying a DC power at the same time to each of inverters individually connected to each of a plurality of induction heating coils, thereby operating a plurality of the induction heating coils concurrently. By obtaining a coefficient which makes the ratio of a rated output voltage during the rated output current operation, and a sum of a rated voltage drop and a rated induced voltage, equal to or greater than a predetermined value, and a phase angle between the rated output voltage and current of the inverter to be controlled, an output frequency of an inverter to be controlled is controlled during a normal operation so as to gain the coefficient ("2" in its embodiment) and phase angle obtained above.

SUMMARY OF THE INVENTION

Problems to be Solved by the Invention

Incidentally, it was possible for a conventional induction heating device configured with a single zone of an induction heating coil which is not divided into multiple pieces, to operate by making a driving frequency follow the natural resonance frequency, therefore it was possible, by minimizing the phase difference between the rising timing of the output rectangular wave voltage of the inverter and the zero-cross timing of the resonant current, to perform the minimum phase angle operation which improves the power factor.

In this regard, in case of the techniques disclosed in Japanese Patent Application Publication No. 2010-287447A and Publication No. 2004-134138A in each of which an induction heating coil is divided into multiple pieces, as a phase angle increases due to a mutual induction voltage, it is impossible to perform a minimum phase angle control in all zones. Therefore, it may be considered to perform a control to minimize the phase angle only in a zone having a high output power (zone 2).

However, a billet undergoes a change from a magnetic material to a non-magnetic material due to rising of a temperature exceeding the Curie point, and a change of the phase angle (decrease of the phase angle) due to a shape change of the object to be heated (void change), thereby having a characteristic that a resonant current is almost tripled in accordance with an increase of the natural resonance frequency.

| | | Cold material | Hot material | Air core coil |
|---|---|---|---|---|
| Equivalent resistance | R (Ratio) | 1 | 0.3 | 0.15 (cir. 1/7) |
| Inductance | L (μH) | 118 | 84 | 110 |

If zones which are not subject to the minimum phase angle control (zones 1, 3) have reached a temperature exceeding the Curie point rapidly, as the inductance L decreases, the natural resonance point increases. (In case of an inverter having a constant frequency, if the natural resonance point increases, the phase angle decreases in order to flow a predetermined current, and thereby a power factor is improved.)

However, if the natural resonance point increases, an inverter voltage Vinv becomes smaller than a mutual induction voltage Vm (Vinv<Vm), then a sharp reverse phase current (reverse current) flows (FIG. 2A).

For example, as an equivalent resistance R of an air core coil becomes 1/7 relative to that of a cold material coil, a voltage of the equivalent resistance $V_R$ and a voltage of the equivalent inductance $V_L$ decrease, without a change on the mutual induction voltage Vm. As a result, the inverter voltage Vinv sometimes becomes smaller than the mutual induction voltage Vm, therefore an operation cannot be performed normally at all load conditions.

In addition, as the output current decreases when the zones 1 and 3 (adjacent zones) becomes at the settling temperature, there is often a case where a phase angle of the maximum output zone (subject zone) becomes small. Also in this case, a zero-cross timing when the resonant current transitions from negative to positive is more advanced than the rising timing of the rectangular wave output voltage of the inverter, and it may become impossible to maintain a ZVS.

For example, by referring to FIG. 9 which shows a temperature variation, as a current rapidly decreases near the settling temperature (1250° C.) at which heating is completed, a current becomes minimal in a zone that has reached the settling temperature first, and a large current continues at each of unreached zones. At this time, the output voltage Vinv of the inverter at the minimum current zone becomes smaller than the mutual induction voltages Vm caused by the respective adjacent zones, therefore an operation cannot be performed normally.

Therefore, the present invention is intended to provide an induction heating device that is capable to ensure a normal operation in a zone which is expected to output a maximum power, a control method thereof, and a control program thereof.

Means for Solving Problem

In order to solve the above problem, as a means of the present invention, either one or a plurality of inverters are controlled with the minimum phase angle, and also a power supply voltage applied to the inverters is varied so that an output voltage (Vinv) of each of the inverters exceeds mutual induction voltages (Vm).

Here, the minimum phase angle is a phase angle with which an output voltage of the inverter (high frequency voltage) does not have a lagging phase relative to a current (Iin) (i.e., a resonant current does not have an advanced phase) at any frequency. To do this, the output voltage (Vinv) is set so as to have a greater value than mutual induction voltages (Vm12 and Vm32) caused by the adjacent zones (Vinv>Vm12, Vinv>Vm32). The phase angle when Vinv=Vm (minimum phase angle) is 30° (see FIG. 2C).

It is preferable that either one or a plurality of inverters (preferably, the maximum output inverter or all inverters) are controlled to have the minimum phase angle.

In addition, the power supply voltage applied to the inverters is varied so that the output voltage of each of the inverters (Vinv) exceeds mutual induction voltages (Vm), to be in the range up to double the mutual induction voltages.

Setting is made so that the output voltage (Vinv) has a greater value than the sum of mutual induction voltages (Vm12, Vm32) caused by the respective adjacent zones (Vinv>(Vm12+Vm32)). Especially, when the mutual induction voltages (Vm12, Vm32) caused by the respective adjacent zones are equal, it becomes Vinv>2|Vm|.

The induction heating device further includes a converter that varies the power supply voltage using a commercial power supply, wherein, when the inverter generates an equivalent sine-wave voltage whose amplitude is modulated, the output voltage is a value obtained by multiplying a value, which is obtained by dividing the power supply voltage (Vdc) by the square root of two, by a modulation factor, and when the inverter is a chopper, the output voltage (Vinv) is defined by multiplying the power supply voltage by a duty ratio (Duty). For example, the output voltage (Vinv) may be set to a value obtained by multiplying the power supply voltage by the duty ratio (Duty) and a waveform distortion ratio (0.9).

Effects of the Invention

According to the present invention, it is possible to ensure the normal operation of the zone that outputs the maximum power. Therefore, when using a plurality of induction heating coils and a plurality of inverters, it is possible to make a substantially resonant current flowing through each of the induction heating coils in a phase lag mode, by following the natural resonance frequency. Note that the inverter supplying the maximum power can reduce a required rating of the conversion device by performing the minimum phase angle control.

EMBODIMENTS OF THE INVENTION

Figure 1A:
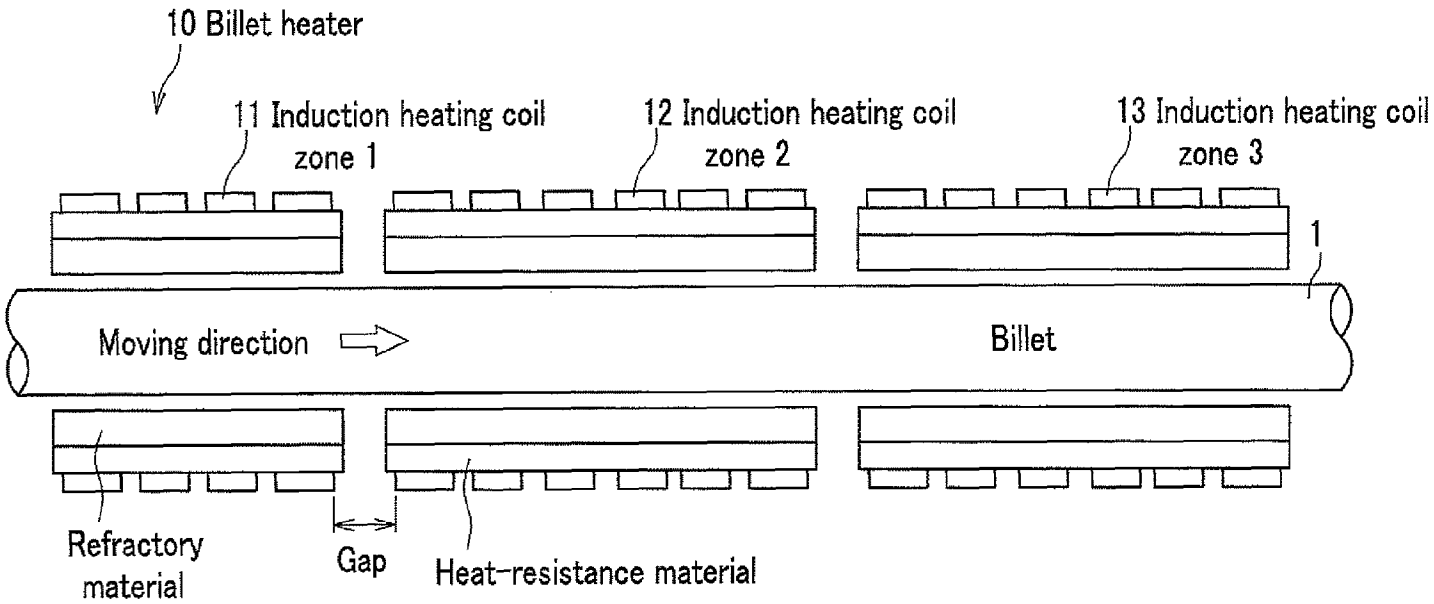
FIGS. 1A and 1B are cross-sectional views of a billet heater used in an induction heating device according to an embodiment of the present invention.

Hereinafter, a description will be given in detail, with reference to the drawings, of the present embodiments according to the present invention. It should be noted that the drawings are merely shown schematically, to such an extent that it is enough to understand the present invention. Accordingly, the present invention is not intended to be limited to illustrated examples only. In addition, the same reference numerals are given for the common components or the same components in respective figures, and redundant description thereof will be omitted.

First Embodiment

Figure 1B:
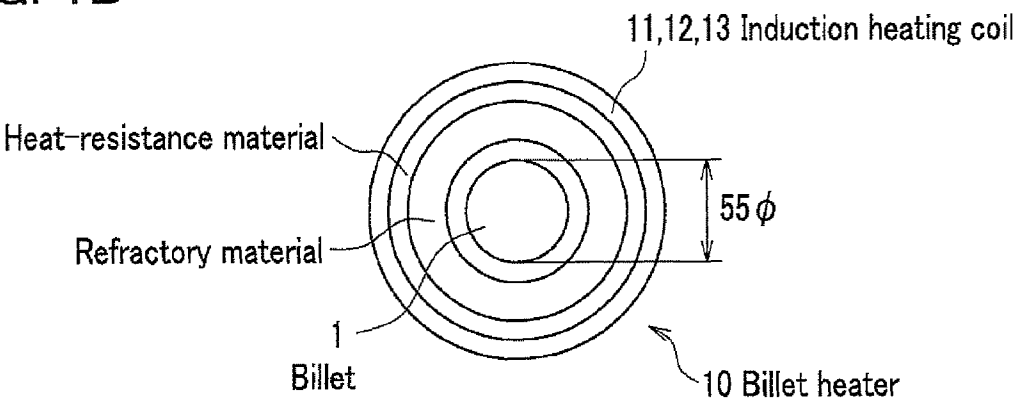
Figure 2A:
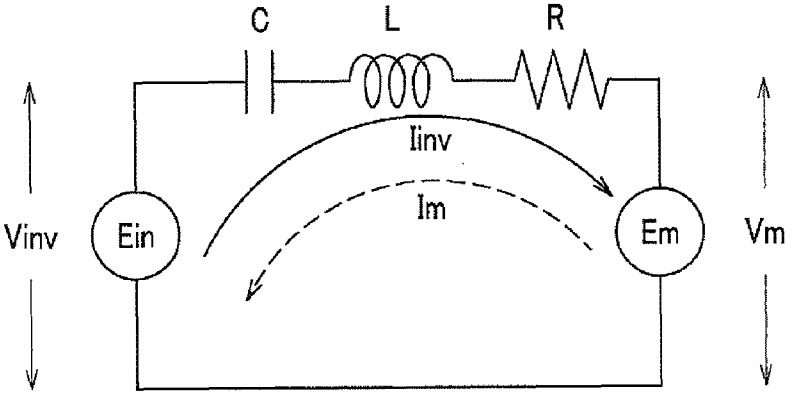
FIG. 2A is an equivalent circuit diagram of the billet heater.
Figure 2B:
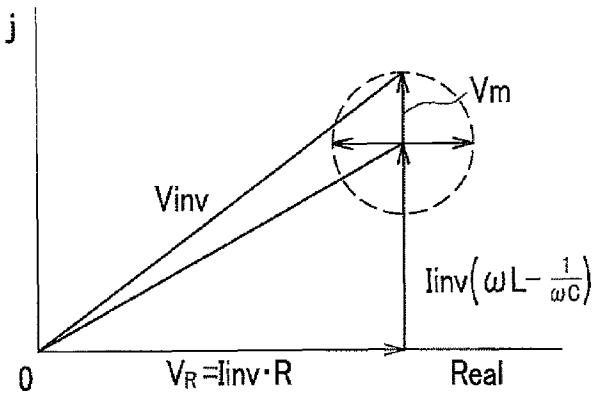
FIGS. 2B and 2C are vector diagrams for explaining an operation.
Figure 2C:
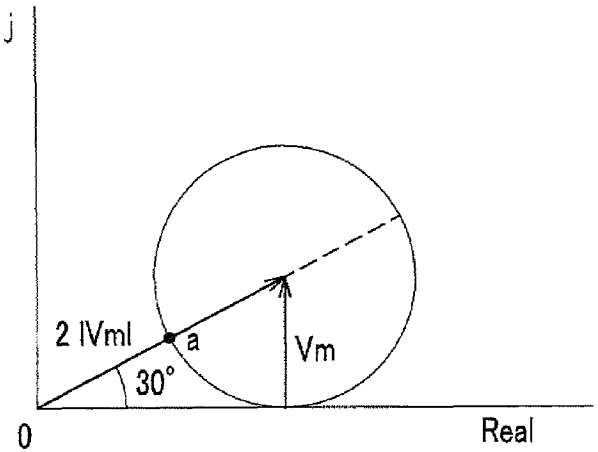
Figure 3:
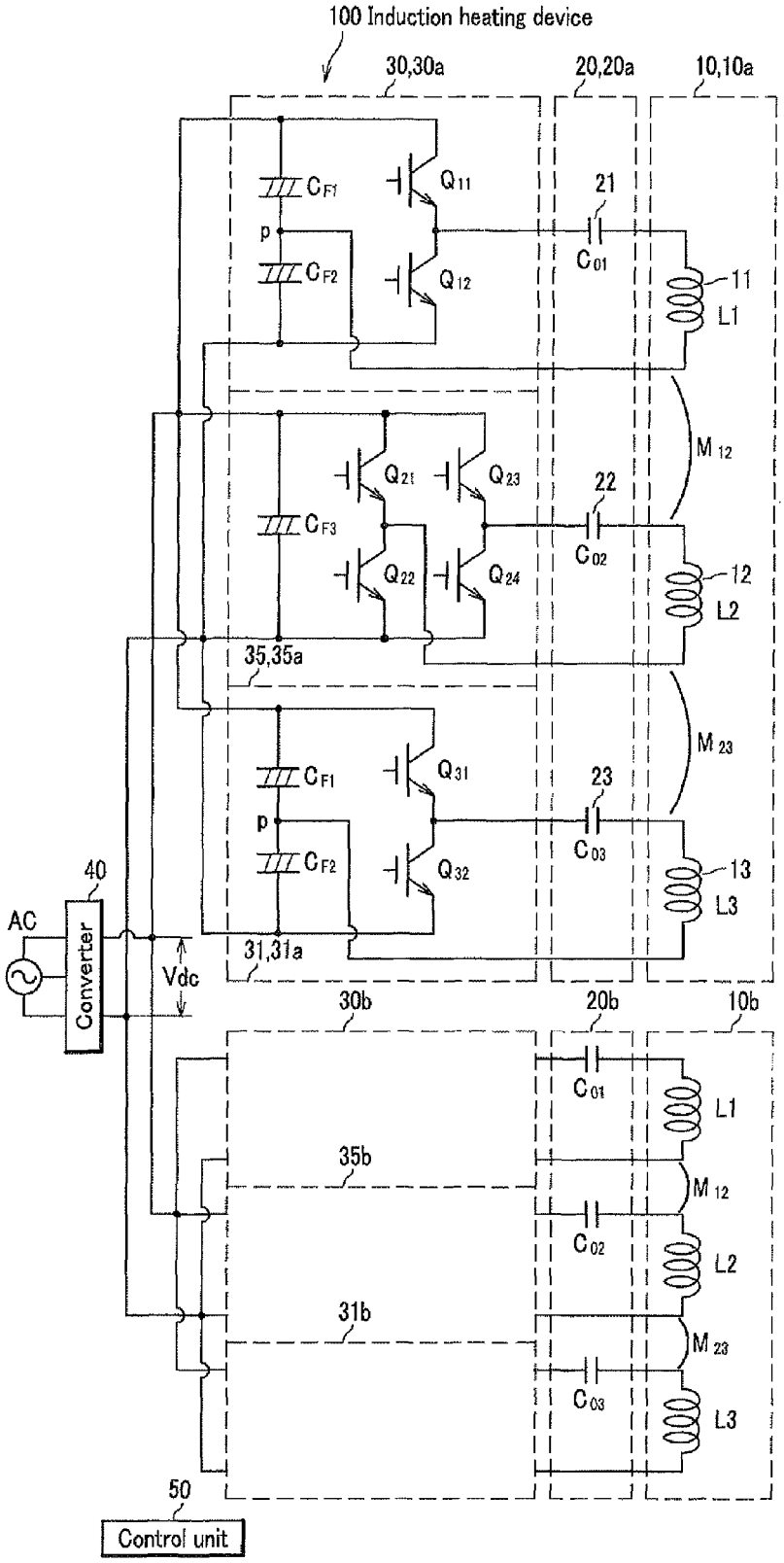
FIG. 3 is a circuit diagram of the induction heating device according to an embodiment of the present invention.

Overall Configuration:

FIGS. 1A and 1B are structural drawings of a billet heater used in an induction heating device according to an embodiment of the present invention, FIG. 2A is an equivalent circuit diagram of the billet heater, FIGS. 2B and 2C are vector diagrams for explaining an operation, and FIG. 3 is a circuit diagram of the induction heating device according to an embodiment of the present invention.

As shown in FIGS. 1A and 1B, a billet heater 10 is provided with a refractory material and a heat-resistant material, each of which has a concentric shape around a columnar billet 1 (ingot) to be heated, and configured with an induction heating coil wound on the surface of the outer periphery of the heat-resistance material. The refractory material and the heat-resistance material are intended to avoid heat radiation of the billet, which is heated to a high temperature, as well as to prevent coil wires from being fused. Note that the diameter of the billet 1 is 55 mm.

In the axial cross-sectional view in FIG. 1A, an induction heating coil is divided into three, zones 1 to 3, via gaps, and constituted with induction heating coils 11, 12 and 13. Note that there are cases that the induction heating coil 12 is called the central induction heating coil, and the induction heating coils 11 and 13 are called the adjacent induction heating coils.

When inductively heating the billet 1, as an eddy current loss occurs, each of the induction heating coils 11, 12 and 13 is equivalently expressed with a series circuit of an equivalent inductor and an equivalent resistor (FIG. 2A). As shown in FIG. 3, the induction heating coils 11, 12, and 13 are connected with capacitors 21, 22 and 23, respectively, in series. Therefore, a series circuit of each of the induction heating coils 11, 12, and 13 and each of the capacitors 21, 22, and 23 is represented equivalently as an RLC series resonant circuit, where an inverter power supply Einv having an output voltage Vinv is connected to one end and an AC power supply Em having a mutual induction voltage Vm is connected to the other end (FIG. 2A). As a result, an inverter current Iinv (solid arrow) flows, and a mutual induction current Im (dashed arrow) flows in the opposite direction. In order to prevent the flow of a reverse current, the output voltage Vinv from each of the inverters 30, 35, and 31 (FIG. 3) must be higher than the mutual induction voltage Vm.

In addition, as the settling temperature (1250° C.) exceeds the Curie point (740° C. to 770° C.), the billet 1 is changed from a magnetic material to a non-magnetic material. Therefore, the natural resonance frequency increases, and the resonant current becomes nearly tripled. As the phase of the mutual induction voltage Vm varies with a frequency by 360°, showing a circular track (FIG. 2B), in order to avoid the output voltage (inverter voltage Vinv) of the inverter (inverter 35) from having a lagging phase (that is, the resonant current has an advanced phase) at any frequency, an output voltage (inverter voltage Vinv) is set to have a value greater than the sum of the mutual induction voltages Vm12 and Vm32 caused by the adjacent zones (zones 1 and 3) (Vinv>(Vm12+Vm32)). When the mutual induction voltages Vm12 and Vm32 caused by zones 1 and 3, respectively, are equal, it becomes Vinv>2|Vm|, and the phase angle when Vinv=2|Vm| is 30° (at a point "a" in FIG. 2C).

In the circuit diagram in FIG. 3, an induction heating device 100 according to an embodiment of the present invention is configured to include two sets of billet heaters 10 (10*a*, 10*b*), two sets of capacitor units 20 (20*a*, 20*b*), two sets of inverters 30 (30*a*, 30*b*), 35 (35*a*, 35*b*), 31 (31*a*, 31*b*), a converter 40, and a control unit 50.

As described with reference to FIG. 1, the billet heater 10 includes induction heating coils 11, 12 and 13 having inductances L1, L2, and L3, respectively, where a mutual inductance between the induction heating coils 11 and 12 is M12, and a mutual inductance between the induction heating coils 12 and 13 is M23. Note that the distance between the induction heating coils L1 and L3 is so long that the mutual inductance therebetween is ignored.

The capacitor unit 20 includes three capacitors 21, 22, and 23 having capacitances $C_{01}$, $C_{02}$, and $C_{03}$, respectively. The capacitors 21, 22, and 23 are respectively connected in series with the induction heating coils 11, 12, and 13, constituting an LC resonant circuit.

Figures 4A, 4B, 4C, 4D:
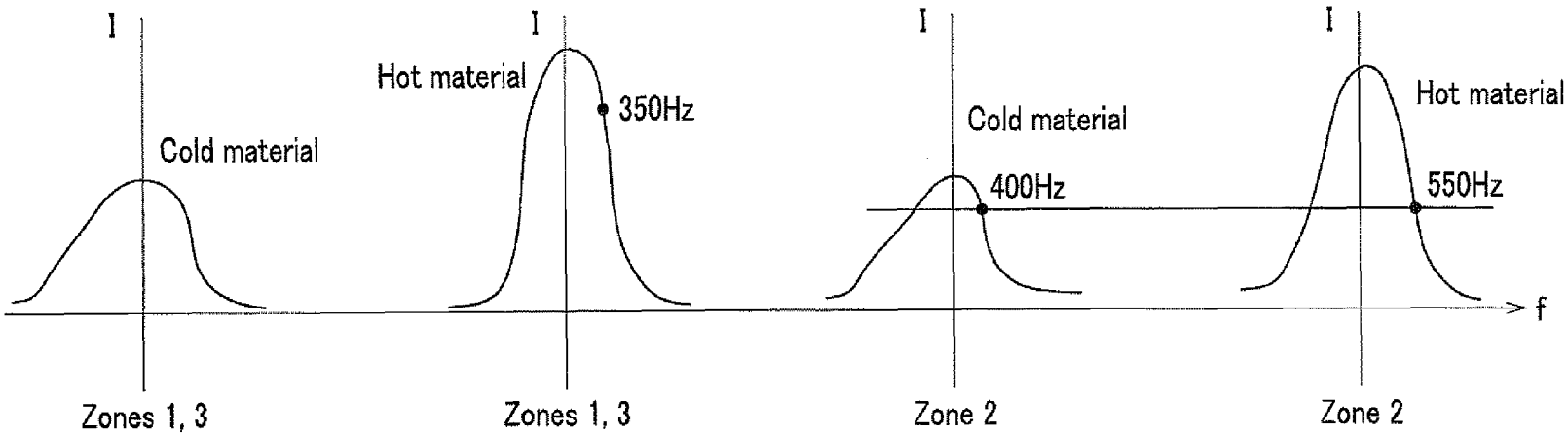
FIGS. 4A-4D are "frequency-current" characteristic diagrams for explaining the resonance characteristics that differ between a cool material and a hot material.

FIGS. 4A-4D are "frequency-current" characteristic diagrams showing the frequency characteristics that varies between a cool material and a hot material of the billet. FIG. 4A shows the characteristic of the cold material in zones 1 and 3, FIG. 4B shows the characteristic of the hot material in zones 1 and 3, FIG. 4C shows the characteristics of the cold material in zone 2, and FIG. 4D shows the characteristic of the hot material in zone 2. As seen in the figures, a current in the hot material is three times larger than that in the cooling member.

As shown in FIGS. 4B and 4C, at the induction heating device 100, the capacitances $C_{01}$, $C_{02}$, and $C_{03}$ of the respective capacitors 21, 22, and 23 (FIG. 3) are set so that the natural resonance frequency (350 Hz) of the hot material in zones 1 and 3 is lower than the natural resonance frequency (400 Hz) of the cold material in the maximum power zone (zone 2).

In other words, at the induction heating device 100, the capacitances of the capacitors 21 and 22 are set so that, when zone 1 has the mutual induction voltages (Vm21 and Vm31, respectively) caused by zones 2 and 3, the output voltage (inverter voltage Vinv) of the inverter 30 in zone 1 has a greater value than the respective mutual induction voltages caused by zones 2 or 3 (Vinv>Vm21 or Vinv>Vm31). Likewise, at the induction heating device 100, the capacitances of the capacitors 22 and 23 are set so that the output voltage (inverter voltage Vinv) of the inverter 31 in zone 3 has a greater value than the respective mutual induction voltages caused by zones 2 or 1 (Vinv>Vm23 or Vinv>Vm13).

In addition, as the resonance frequency of a hot material becomes higher than that of the cold material, by performing a control to follow the change in the natural resonance frequency in respective zones, as seen in FIGS. 4C and 4D, the induction heating device 100 is capable to equalize the resonant currents in the respective zones, while maintaining the inverter voltages Vinv identical.

More specifically, at the induction heating device 100, when a cold material having the natural resonance point 400 Hz is heated to become a hot material in zone 2, the resonant current becomes tripled and the natural resonance point rises up to 550 Hz as well. By making the natural resonance point of 550 Hz to be followed, the resonant current is decreased so as to be controlled with the equivalent resonant current of the cold material. At this time, as zones 1 and 3 of the induction heating device 100, even though the natural resonance frequencies thereof are set low to 350 Hz, are driven at 550 Hz which is the same frequency as zone 2, the resonant current is further decreased. That is, as the mutual induction voltages caused by zones 1 and 3 remain unchanged, the output voltage (inverter voltage Vinv) of each of the inverters 30 and 31 is decreased.

The inverter 30 (31) shown in FIG. 3 includes electrolytic capacitors $C_{F1}$, $C_{F2}$ that are connected in series, and two IGBTS (Insulated Gate Bipolar Transistors) Q11, Q12 (Q31, Q32), constituting a half-bridge circuit and supplying a power to the induction heating coil 11 (13) via a capacitor 21 (23).

At the inverter 30 (31), the emitter terminal of the transistor Q11 and the collector terminal of the transistor Q12 are connected, the DC voltage Vdc is applied across the collector terminal of the transistor Q11 and the emitter terminal of the transistor Q12, and the DC voltage Vdc is applied across the electrolytic capacitors $C_{F1}$, $C_{F2}$ that are connected in series.

At the induction heating device 100, a connection point between the emitter terminal of the transistor Q11 and the collector terminal of the transistor Q12, and one end of the capacitor 21 are connected, the other end of the capacitor 21 and one end of the induction heating coil 11 are connected, and the other end of the induction heating coil 11 and a connection point P between the electrolytic capacitors $C_{F1}$ and $C_{F2}$ are connected.

The inverter 35 includes a single electrolytic capacitor $C_{F3}$, and four transistors Q21, Q22, Q23, Q24, constituting a full bridge circuit and supplying a higher power to the induction heating coil 12, via a capacitor 22, than the inverters 30 and 31.

At the inverter 35, the emitter terminal of the transistor Q21 and the collector terminal of the transistor Q22 are connected, the emitter terminal of the transistor Q23 and the collector terminal of the transistor Q24 are connected, the DC voltage Vdc is applied across the collector terminals of the transistors Q21, Q23 and the emitter terminals of the transistors Q22, Q24, and the DC voltage Vdc is applied to the electrolytic capacitor $C_{F3}$. At the induction heating device 100, a connection point between the emitter terminal of the transistor Q23 and the collector terminal of the transistor Q24, and one end of the capacitor 22 are connected, and the other end of the capacitor 22 and one end of the induction heating coil 12 are connected.

In addition, at the induction heating device 100, a connection point between the emitter terminal of the transistor Q21 and the collector terminal of the transistor Q22, and the other end of the induction heating coil 12 are connected.

The inverter 31 has the similar configuration to the inverter 30, and the inverters 30*b*, 35*b*, 31*b* have identical configurations to the inverters 30*a*, 35*a*, 31*a*, respectively.

The converter 40 includes a diode bridge 41 and a chopper 45 (FIG. 5), and, by generating a DC voltage Vdc using a commercial power source AC, supplies a power to a first inverter assembly (inverters 30*a*, 35*a*, 31*a*) and a second inverter assembly (inverters 30*b*, 35*b*, 31*b*). Thus, the converter 40 applies the identical DC voltage Vdc to the respective inverters 30*a*, 35*a*, 31*a*.

It should be noted that the capacitances $C_{01}$, $C_{02}$, $C_{03}$ of the respective capacitors 21, 22, 23 are set, as described above with reference to FIG. 4, so that the natural resonance frequency of the hot material in zones 1, 3 becomes lower than the natural resonance frequency of the cold material in the maximum power zone (zone 2).

Figure 5:
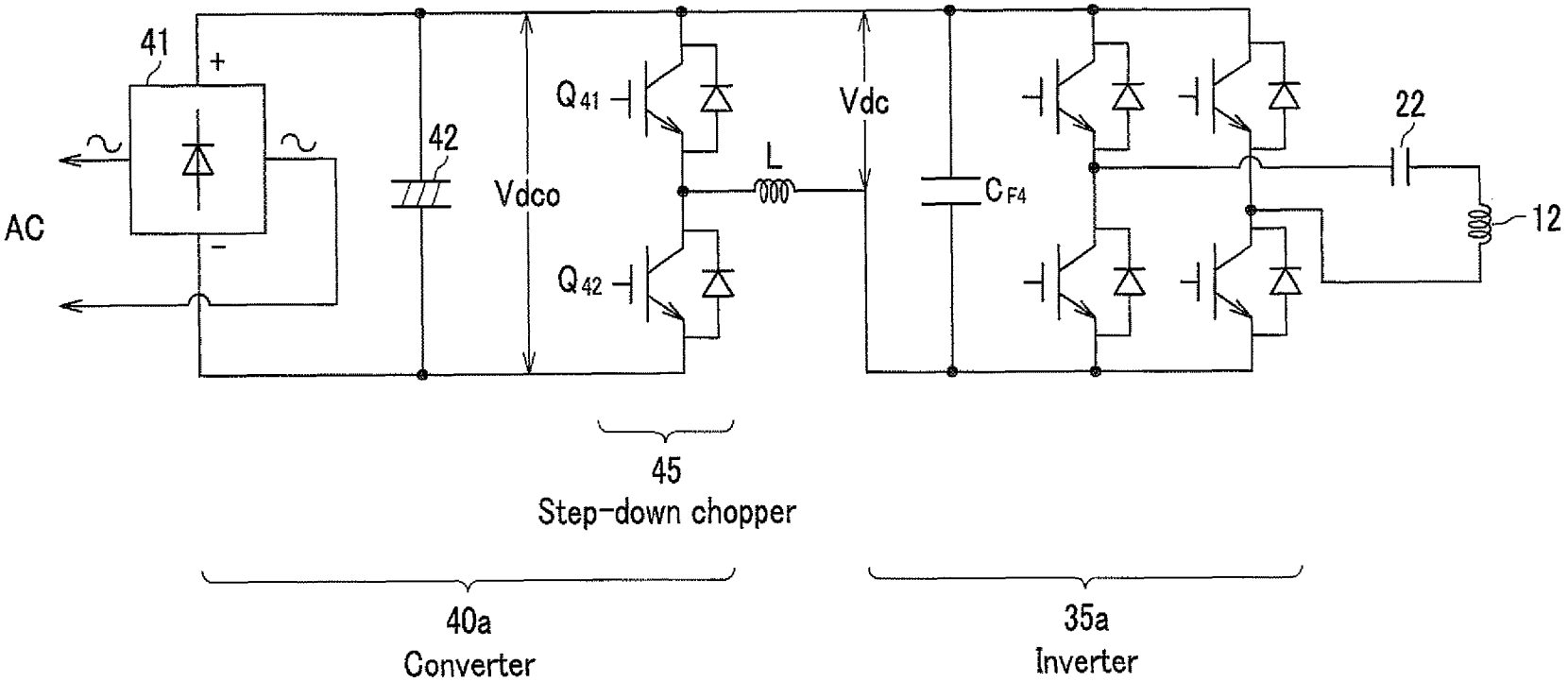
FIG. 5 is a circuit diagram for explaining a converter and an inverter, at an induction heating device according to an embodiment of the present invention.

FIG. 5 is a circuit diagram for explaining a converter and an inverter, in an induction heating device according to an embodiment of the present invention.

A converter 40*a* includes a diode bridge 41, an electrolytic capacitor 42, transistors (IGBTS) Q41 and Q42 as switching elements, a commutation diode, and a smoothing reactor L. The diode bridge 41 performs full-wave rectification of the AC voltage of the commercial power supply. The electrolytic capacitor 42 smoothes the DC voltage rectified by the diode bridge 41. The transistors Q41 and Q42, and the commutation diode generate a rectangular wave voltage, by intermitting a voltage Vdco across the electrolytic capacitor 42 at a predetermined DUTY ratio. The smoothing reactor L smoothes the rectangular wave voltage generated by the IGBTS Q41 and Q42.

The inverter 35*a* has the similar configuration as described above, but a film capacitor (capacitor $C_{F4}$) having a small capacitance may be used instead of the electrolytic capacitor $C_{F3}$. Note that the DC voltage Vdc refers to a voltage across a capacitor $C_{F3}$ or $C_{F4}$.

Function of Control Unit:

The control unit 50 is intended to generate a gate signal for controlling gates of the transistors (IGBTS) within the inverters 30, 31, 35, including a ROM (Read Only Memory), a RAM (Random Access Memory), and a CPU (Central Processing Unit), and realizes the following functions, by the CPU executing a predetermined program stored in a storage medium.

1) Drive all Zones with Synchronized Currents at the Same Frequency:

As the divided induction heating coils 11, 12, 13 are disposed close to each other, it becomes a state that the mutual induction inductances M12 and M23 are present, causing the mutual induction voltages Vm. In order to avoid the phase difference among the magnetic fields that are generated between the respective induction heating coils in association with transfer of powers between the respective inverters, zones 1, 2, 3 are driven with sine-wave currents that have the same frequency and are synchronized as well. Accordingly, it is possible to avoid a symptom such that an amount of heat generation is decreased locally, thereby causing uneven heating.

Figure 6A:
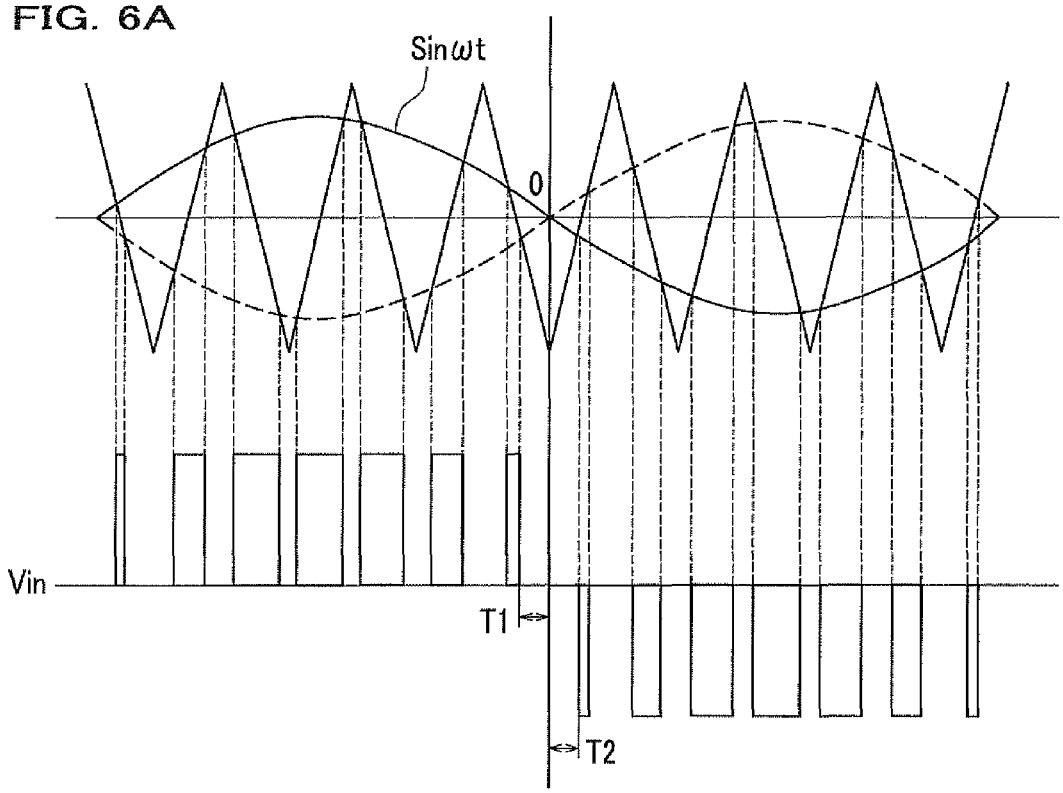
FIGS. 6A and 6B are explanatory diagrams for explaining an equivalent sine-wave voltage and an average value control.
Figure 6B:
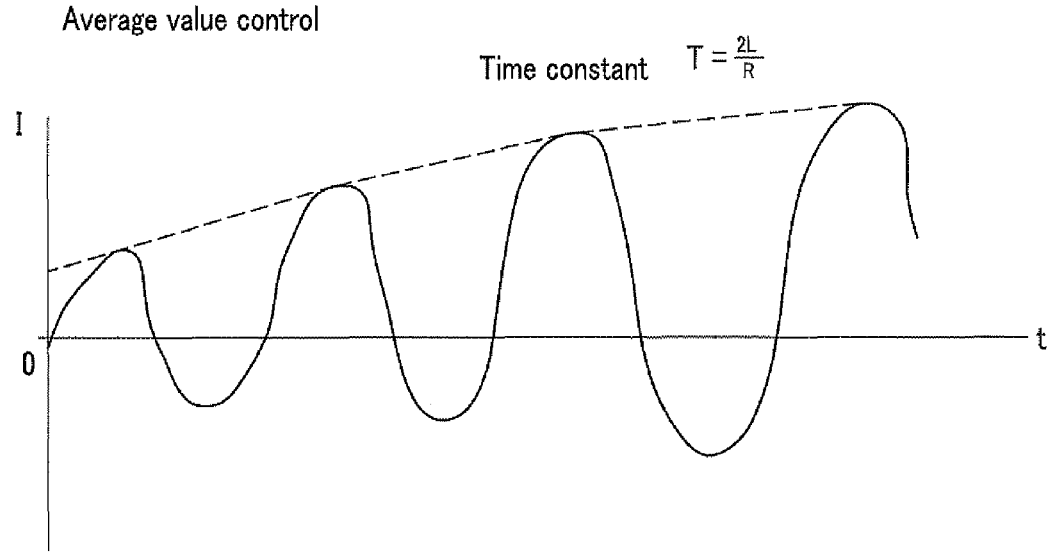

2) Operate the Inverters 30, 35, 31 as PWM Non-Resonance Inverters:

The control unit 50 operates the inverters 30, 35, 31 as PWM non-resonance inverters. Specifically, as it is necessary to implement a ZVS, each of the inverters 30, 35, 31, by performing a PWM modulation on a rectangular wave voltage having a predetermined carrier frequency using a sign-wave signal (Sin ωt) operating at a predetermined frequency, generates an equivalent sine-wave voltage having a rectangular waveform (FIG. 6A in case of the inverter 35 which is a full-bridge circuit). This equivalent sine-wave voltage is averaged with an L-R time constant (or L1-$C_{01}$-R time constant), and a coil current having a substantially sine waveform flows through each of the induction heating coils 11, 12, 13. Then, the control unit 50 performs an average control to prolong a time constant for the synchronization control longer than the resonance time constant (T=2L/R) (see FIG. 6B), and a feedback control over the equivalent sine-wave voltage of each of the inverters 30, 35, 31 so that the coil current becomes to have a targeted operating frequency and a targeted phase. Note that the targeted phase refers to a phase between the zero-crossing point at which the sine-wave signal for generating the equivalent sine wave transitions from negative to positive, and the zero-crossing point at which the coil current having the substantially sine waveform transitions from negative to positive. Thus, the control unit 50, by performing a PWM control, generates an equivalent sine-wave signal having the operation frequency of 1 k Hz using a triangular wave signal having the carrier frequency of 8 k Hz, thereby controlling each of the gates of the IGBTS in the inverters 30, 35, 31.

3) Perform the Minimum Phase Angle Control:

The inverter 35 in zone 2 which outputs the maximum power is undergoing the minimum phase angle control, while being made to follow the natural resonance frequency. A description will be given below of the minimum phase angle control.

A control is performed for the maximum output zone (zone 2) to have the minimum phase angle (e.g., 30°).

Specifically, as described above, the minimum phase angle is set so that the output voltage (inverter voltage Vinv) has a greater value than the sum of the mutual induction voltages Vm12 and Vm32 caused by the adjacent zones (zones 1 and 3) (Vinv>(Vm12+Vm32)). When the mutual induction voltages Vm12 and Vm32 caused by zones 1 and 3 are equal, it becomes Vinv>2|Vm| (FIG. 2C), and the minimum phase angle at this time is 30°.

Note that in order to output the inverter voltage Vinv which is always greater than the mutual induction voltages Vm caused by other zones, even with a change in the natural resonance frequency, it is conceivable to be operated at a fixed frequency which allows a sufficiently large phase angle. However, the following problems arise.

a) As a phase angle is sufficiently large, it is impossible to be operated with a high power factor.

b) As a conventional inverter outputs the inverter voltage Vinv which is greater than the mutual induction voltages Vm, a margin is required in the volt-ampere rating (effective power Vdc×Idc).

In addition, in case of a ZCIH, as a zone having the largest proportion of output relative to the rated power is made to have the minimum phase angle, the capacitances are set so that the natural resonance point (350 Hz) of hot materials in zones 1 and 3 becomes lower than the natural resonance point (400 Hz) of a cold material in zone 2 (FIG. 2A). It should be noted that as coil voltages in zones 1 and 3 are low, capacitors may be omitted therein.

Configuration of Control Unit:

Next, a specific description will be given of a configuration of the control unit 50 for controlling the inverters 30, 31, 35 and the converter (chopper) 45.

Figure 7:
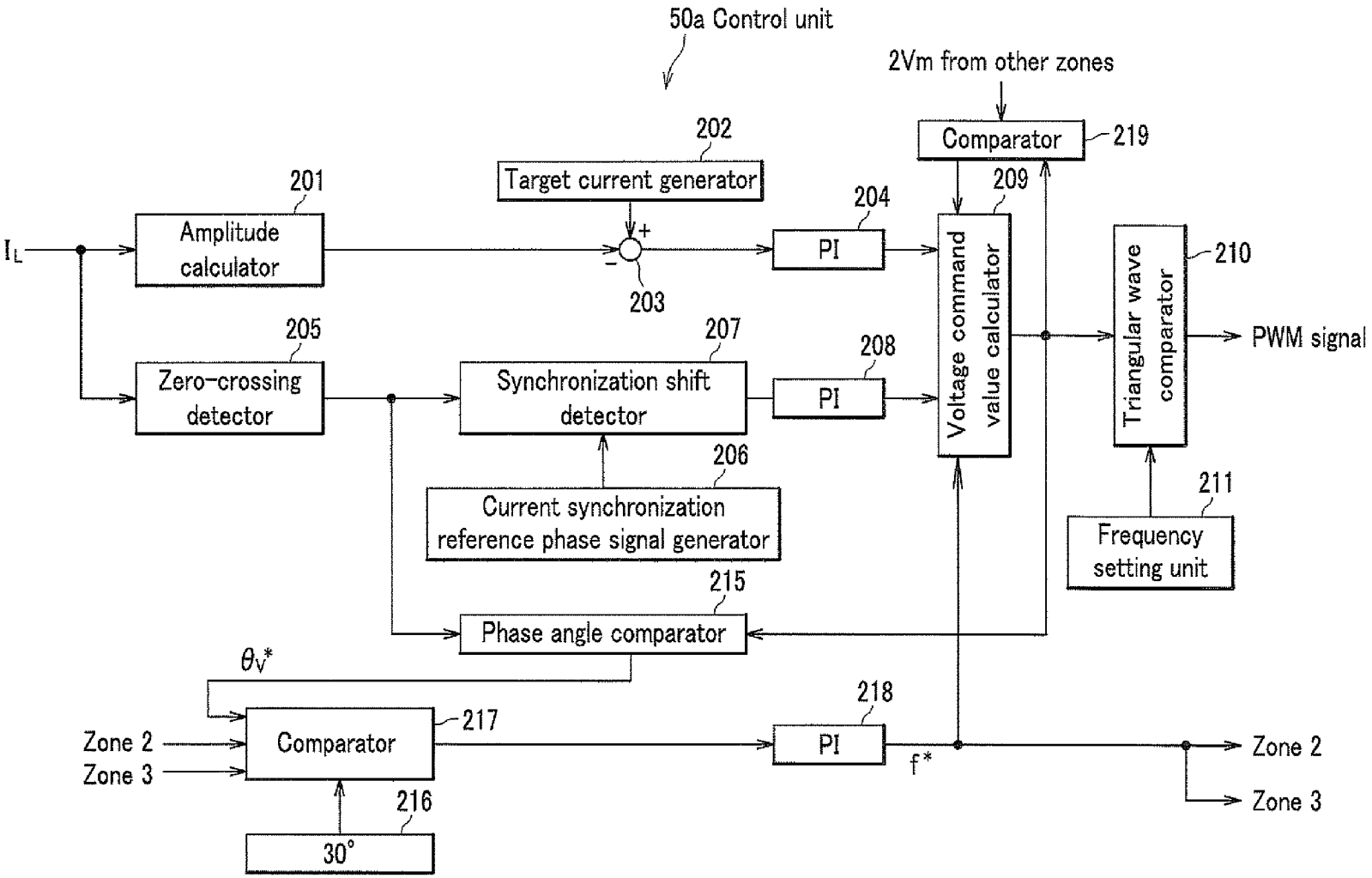
FIG. 7 is a block diagram of a control unit that controls an inverter.

FIG. 7 is a block diagram of a control unit 50*a* for controlling the inverters 30, 31, 35, especially showing a block diagram of a control unit for controlling zones 1 and 3, even though a block diagram of a control unit for controlling zone 2 being the same. The control unit 50*a* is externally provided with an A/D converter, and detects a coil current $i_L$.

The control unit 50*a* includes an amplitude calculator 201, a target current generator 202, an adder 203, PI calculators 204 and 208, a zero-crossing detector 205, a current synchronization reference phase signal generator 206, a synchronization shift detector 207, a voltage command value calculator 209, a triangular wave comparator 210, a frequency setting unit 211, a phase angle comparator 215, a 30° reference value generator 216, comparators 217 and 219, and a PI controller 218.

The amplitude calculator 201 calculates the amplitude of the A/D converted value $I_L$ of the coil current $i_L$. The target current generator 202 generates a target value of the coil current $i_L$. The adder 203 outputs an error signal by subtracting the output waveform of the amplitude calculator 201 from the output value of the target current generator 202. The PI controller 204 performs a proportional-integral calculation on the error signals which the adder 203 outputs.

The zero-crossing detector 205 calculates the zero-cross point, where the coil current $i_L$ is changed from negative to positive, using the A/D converted value $I_L$ of the coil current $i_L$. In order to synchronize the coil currents flowing through the respective induction heating coils 11, 12, 13, the current synchronization reference phase signal generator 206 outputs the reference values of the phase difference between the respective coil currents and that of the target current generator 202. The reference value is set to the minimum phase angle of 30° for zone 2, and probably to a greater value than the minimum phase angle for zones 1 and 3, because power consumption therein is small.

The synchronization shift detector 207 detects the difference (synchronization shift) between the output value of the current synchronization reference phase signal generator 206, and the output value of the zero-crossing detector 205. The PI controller 208 performs a proportional-integral calculation on the output deviation of the synchronization shift detector 206.

Based on the output signal of the PI controllers 204, 208 and the frequency command value f*, the voltage command calculator 209 generates a voltage command value Vinv* indicating a sine waveform of the operation frequency of 1 k Hz. The frequency setting unit 211 outputs the value of the carrier frequency of 8 k Hz. By comparing the voltage command value Vinv* and the triangular wave signal of the carrier frequency set by the frequency setting unit 211, the triangular wave comparator 210 generates a PWM control signal. By inputting the PWM control signal to the inverters 30, 35, 31, and feeding back the coil current $i_L$ flowing through each of the induction heating coils 11, 12, 13 as an A/D converted value $I_L$, the amplitude of the coil current $i_L$ is converged on the waveform of the sine wave signal of the operation frequency, and phases when the coil currents $i_L$ transition from negative to positive in the respective zones coincide with one another. In addition, the zero-crossing point of the voltage command value Vinv* indicating the sine waveform and the reversal timing of the triangular wave signal coincide. As a result, when the voltage command value Vinv* zero-crosses, as well as a rectangular waveform voltage of the output voltage Vinv of each of the inverters 30, 35, 31 is inverted from positive to negative or vice versa, lengths of time T1 and T2 (FIG. 6A) between the respective timings before and after the transition from positive to negative or vice versa at the origin 0, and the zero-crossing point become identical.

The phase angle comparator 215 compares the output phase of the zero-crossing detector 205, and a phase of the voltage command value Vinv* which the voltage command value calculator 209 outputs. That is, the phase angle comparator 215 calculates the phase difference between the sine-wave signal of the voltage command value Vinv* and the coil current $i_L$, then outputs a voltage-current phase difference of θv*. The 30° generator 216 outputs the value of 30° which is the minimum phase angle.

The comparator 217 compares the voltage-current phase difference of θv*, which the voltage phase angle comparator 215 outputs, with the value of 30°, then outputs a negative constant value when the value of the voltage-current phase difference of θv* is greater than 30°, while outputs a positive constant value when the value of the voltage-current phase difference of θv* is smaller than 30°. At this time, the comparator 217 also compares a voltage-current phase difference from each of the other zones (zones 2 and 3), with the value of 30°. The PI controller 218 performs a proportional-integral operation on the output signal of the comparator 217, and outputs a frequency command value f* of approximately 1 k Hz to the voltage command value calculator 209. By doing this, a feedback control is performed so that the frequency command value f* is to be lowered when the value of the voltage-current phase difference θv* is greater than 30°, while the frequency command value f* is to be raised when the value of the voltage-current phase difference θv* is smaller than 30°.

The comparator 219 compares the voltage command value Vinv* and double the mutual induction voltages Vm (2Vm) caused by other zones, and outputs a comparison result to the voltage command value calculator 209. Here, when the voltage command value Vinv* is smaller than 2Vm caused by other zones, the voltage command value calculator 209 performs a minor loop feedback control in order to raise the value of the voltage command value Vinv*. Note that the mutual induction voltage Vm at zone 1 caused by zones 2 and 3, is calculated by $Vm=(M_{12}i_2+M_{13}i_3)$.

Figure 8:
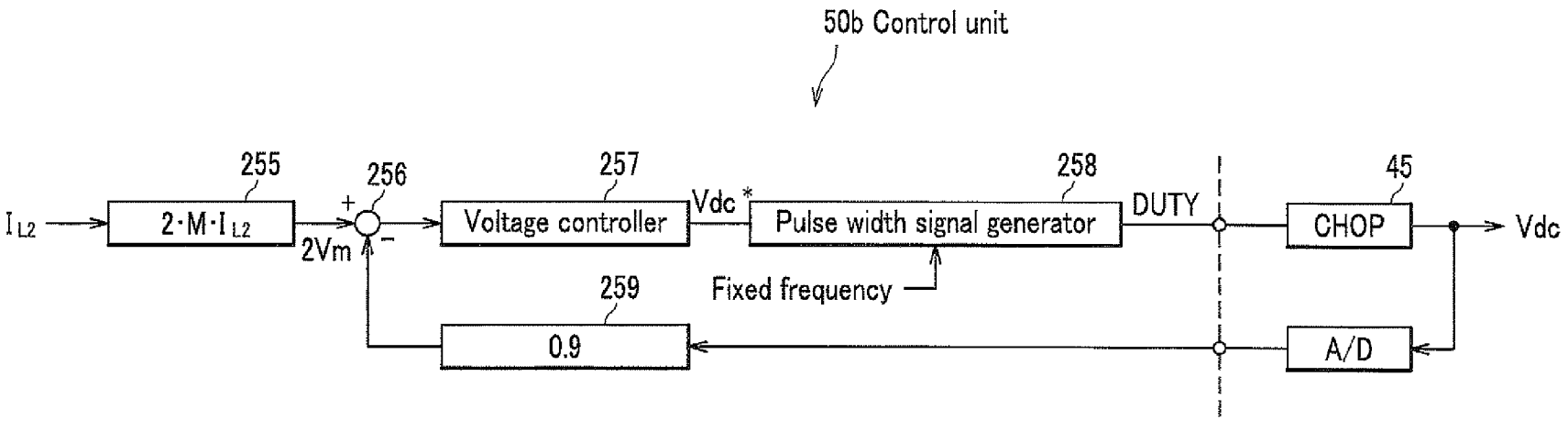
FIG. 8 is a block diagram of a control unit that controls a chopper.

FIG. 8 is a block diagram of a control unit for controlling the chopper.

In order to control the chopper 45, the control unit 50*b* generates a pulse width control signal DUTY, based on a coil current $i_{L2}$ in zone 2, and the DC voltage Vdc after smoothing the rectangular wave voltage output of the chopper 45. The control unit 50*b* includes gain units 255 and 259, an adder 256, a voltage controller 257, and a pulse width signal generator 258.

By multiplying the A/D converted value $I_{L2}$ of the coil current $i_L$ in zone 2 by double the mutual induction coefficient M (2M), the gain unit 255 outputs a value of $2MI_{L2}$. As the mutual induction voltage Vm is $MI_{L2}$, the gain unit 255 outputs 2Vm. The gain unit 259 multiplies the DC output voltage Vdc of the chopper 45 by the waveform distortion rate 0.9. The adder 256 subtracts the output value of the gain unit 259 from the output value of the gain unit 255.

The voltage controller 257 calculates the DC voltage command value Vdc* using a deviation which the adder 256 outputs. By comparing the DC voltage command value Vdc* and the triangular wave signal having a fixed frequency, the pulse width signal generator 258 generates a pulse width control signal DUTY. By inputting the pulse width control signal DUTY as a gate signal for the chopper 45, the chopper 45 is feedback controlled to output double the DC voltage of the mutual induction voltage at zone 2.

Effects:

According to the present embodiment, the inverter 35 for the maximum output zone (zone 2) is controlled so that the phase angle between the rising timing of the rectangular wave voltage of the inverter output and the zero-cross timing of the resonant current transitioning from negative to positive becomes minimal.

The minimum phase angle is set so that, when the mutual induction voltages (Vm12 and Vm32) are caused by the adjacent zones (zones 1 and 3), the output voltage of the inverter 35 (inverter voltage Vinv) for the central zone (zone 2), which is the maximum output zone, becomes greater than the sum of the mutual induction voltages (Vm12 and Vm32) caused by zones 1 and 3 (Vinv>(Vm12+Vm32).

In addition, the capacitances of the capacitors 21, 22, 23 are set so that the natural resonance frequency of the hot material at the Curie point or higher in the adjacent zones (zones 1 and 3) is equal to or lower than the natural resonance frequency of the cold material in the maximum power zone (zone 2). That is, the capacitances of the capacitors 21, 22, 23 are set so that, when the mutual induction voltages (Vm21 and Vm31) are caused by zones 2 and 3, the output voltage Vinv of the inverter 30 in zone 1 has a higher value than the mutual induction voltages Vm21 or Vm31 (Vinv>Vm21 or Vinv>Vm31).

The inverters 30, 35, 31 generate equivalent sine-wave voltages that are PWM modulated at the predetermined carrier frequency, which equivalent sine-wave voltage are then averaged using the L-R time constant, and the coil currents of substantially sine waveform flow through the induction heating coils 11, 12, 13. Accordingly, as each of the inverters 30, 35, 31 can perform a ZVS, the commutation diodes shall not change from the ON state to the OFF state, and hence the recovery currents do not flow. Then, the PWM control is performed on the equivalent sine wave voltages generated from the inverters 30, 35, 31 so that, by prolonging the synchronization control time constant longer than the resonance time constant (T=2L/R), the frequencies of the coil currents become the targeted operation frequency having the targeted phase. In other words, the inverters 30, 35, 31 work as PWM resonance inverters.

In addition, the maximum power zone (zone 2) undergoes the minimum phase angle control. Accordingly, it is possible to perform a phase control over the adjacent zones (zones 1 and 3) by making them to follow the natural resonance frequency of the induction heating coils 11, 12, 13, therefore it is possible to perform a ZVS, while having an identical frequency and synchronizing currents. Note that it is possible, by performing a control for operating in the resonant current phase lag mode and the minimum phase angle control, to reduce a required capacity of the inverter 35 that supplies the maximum power.

Therefore, it is possible to operate the inverter with a high power factor, to improve efficiency therewith, and to reduce a required capacity of the inverter (conform to the rated capacity).

Figure 9:
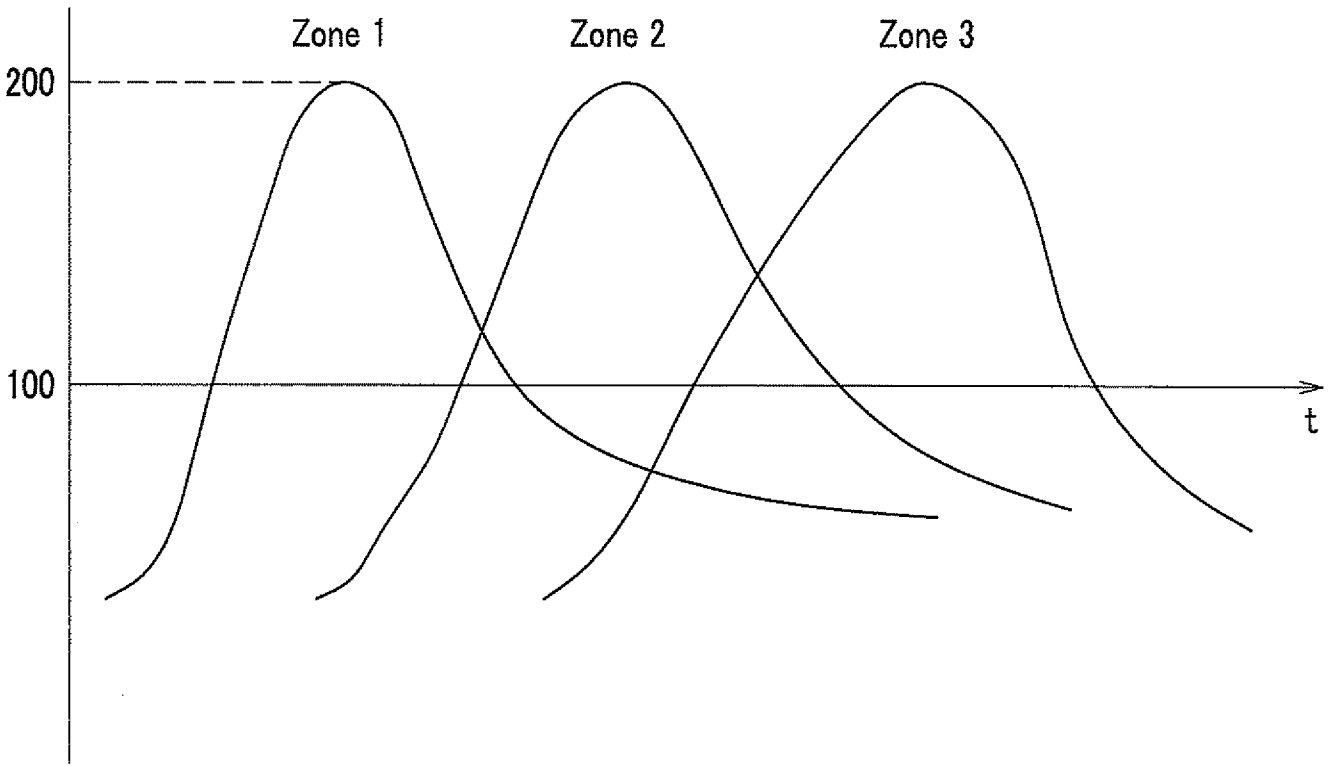
FIG. 9 is a diagram showing a temperature change in respective zones.

FIG. 9 is a diagram showing a temperature change in respective zones.

The current decreases rapidly near the settling temperature (1250° C.) at which the heating is completed.

Therefore, a current becomes minimal in the zone which has reached the settling temperature first, while currents are continuously large in the zones which have not reached the settling temperature yet. At this time, the output voltage Vinv of the inverter in the minimal current zone is smaller than the mutual induction voltage Vm caused by the adjacent zones. For this reason, the output voltage of the chopper 45 is increased so as to be in the range of Vm to 2Vm.

Second Embodiment

The first embodiment is configured with independent circuits, using half-bridge circuits in the inverters 30 and 31, and a full bridge circuit in the inverter 35, but in case of a three-zone configuration, zones can be connected in parallel using a three-phase IPM (Intelligent Power Module) module.

Figure 10:
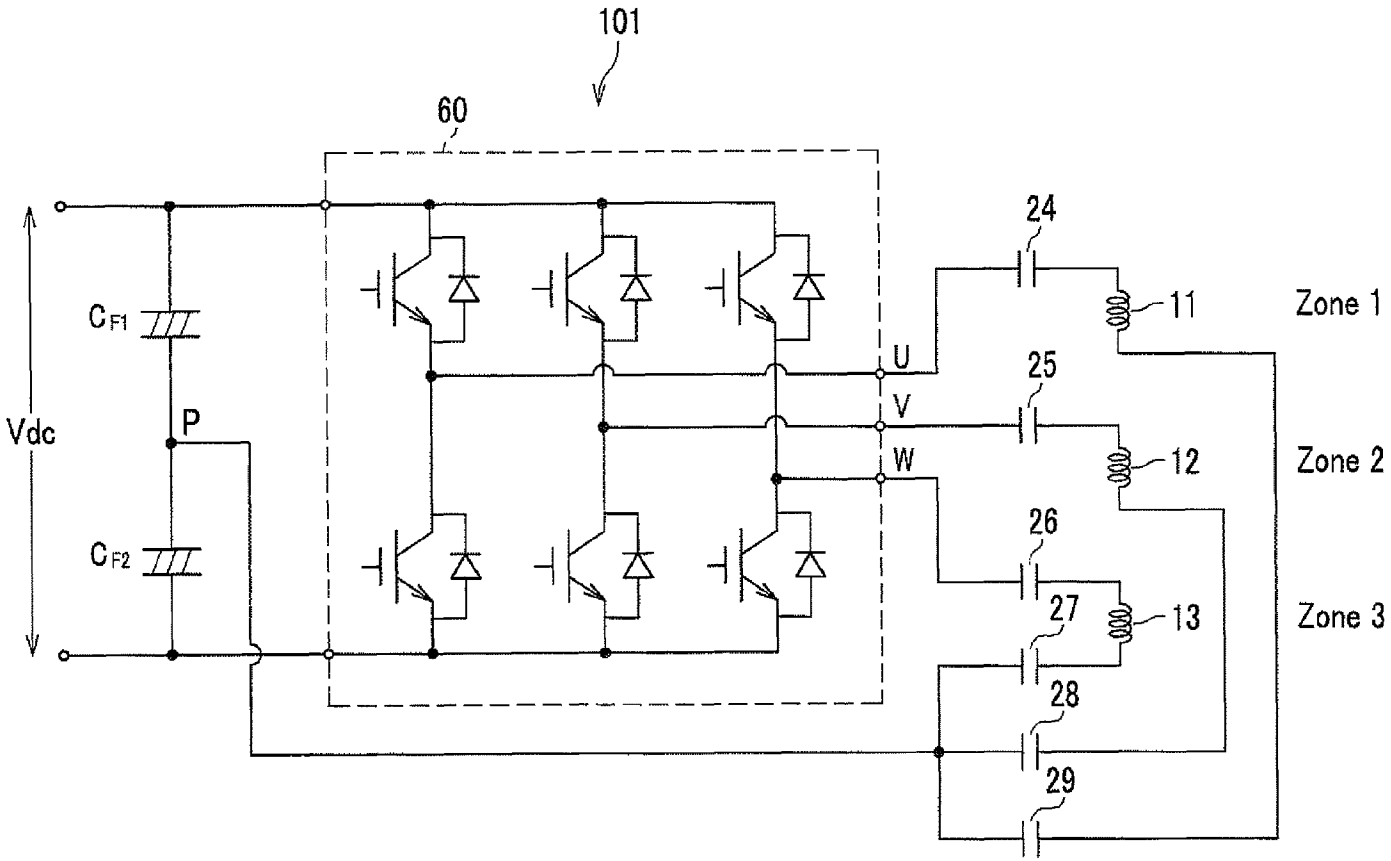
FIG. 10 is a circuit diagram of a second embodiment using an IPM module.

FIG. 10 is a circuit diagram of an inverter and a billet heater using an IPM module.

An IPM module is generalized for the purpose of driving a three-phase motor, by modularizing six IGBTS and six commutation diodes. An IPM module 60 includes a power supply terminals V+, V−, output terminals U, V, W, and a gate terminal.

An induction heating device 101 is configured with three half-bridge circuits, using an IPM module 60, for three induction heating coils 11, 12, 13, respectively, where electrolytic capacitors $C_{F1}$, $C_{F2}$ in series connection are connected to both ends of the power supply terminals V+, V−, and the DC voltage Vdc is applied thereto. Each of the output terminals U, V, W is connected to one end of each of the capacitors 24, 25, 26, the other end thereof is connected to one end of each of the induction heating coils 11, 12, 13, the other end thereof is connected to one end of each of the capacitors 27, 28, 29, and the other end thereof are collectively connected to a connection point P between the electrolytic capacitor $C_{F1}$, $C_{F2}$. Note that the capacitance of each of the capacitors 24, 25, 26, 27, 28, 29 is double the capacitance of each of the capacitors 21, 22, 23 (FIG. 2).

As it is possible, by using the IPM module 60, to realize a simple and compact ZCIH, an IPM module is suitable for use in the semiconductor substrate heating.

Third Embodiment

The second embodiment uses a single IPM module, but two or more IPM modules can be connected in parallel to increase a capacity of a conversion device.

Figure 11:
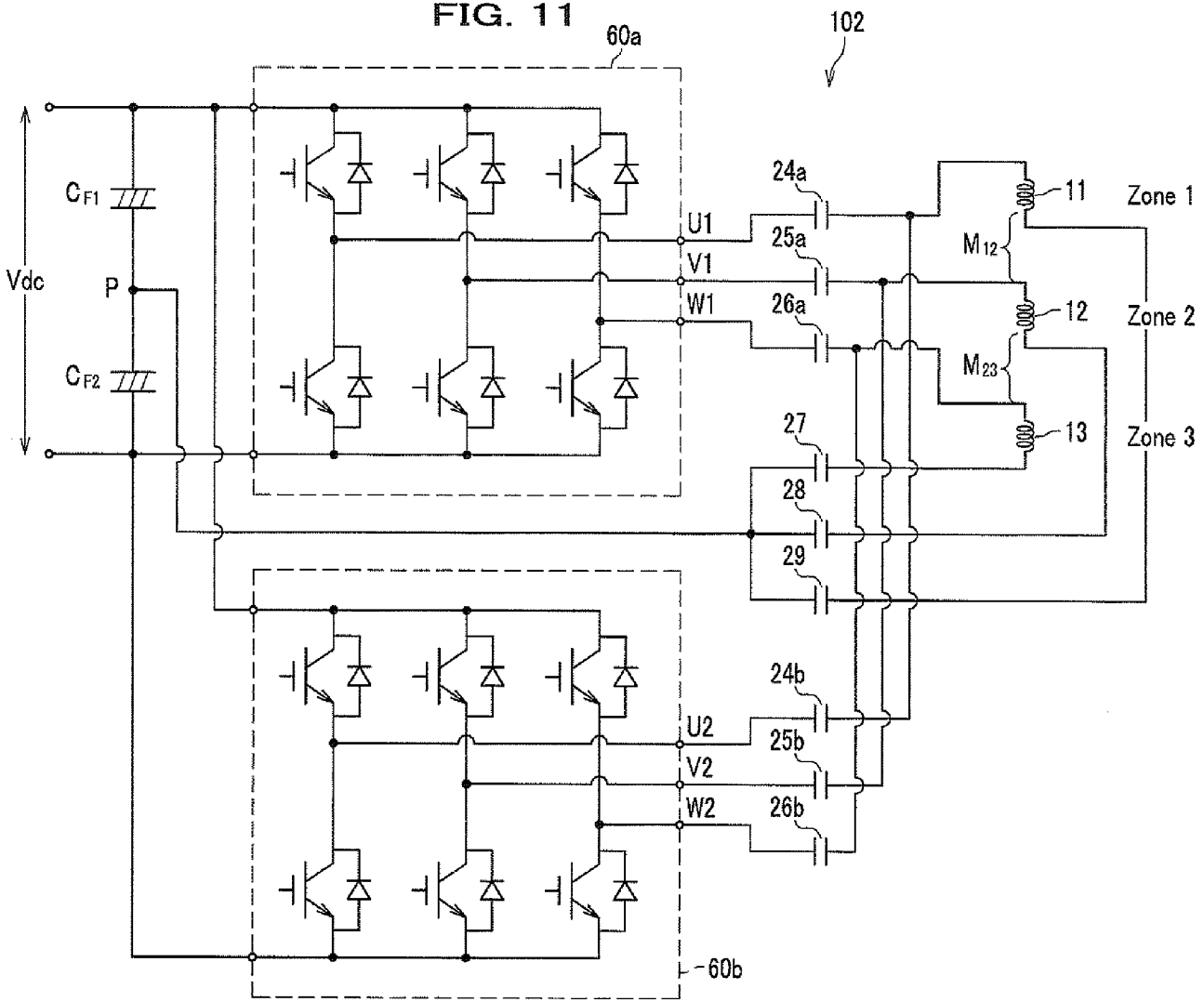
FIG. 11 is a circuit diagram of a third embodiment using IPM modules.

FIG. 11 is a circuit diagram of inverters and peripherals of a billet heater, using IPM modules.

An induction heating device 102 includes two IPM modules 60*a* and 60*b*, electrolytic capacitor $C_{F1}$ and $C_{F2}$, capacitors 24*a*, 25*a*, 26*a*, capacitors 27, 28, 29, capacitors 24*b*, 25*b*, 26*b*, and induction heating coils 11, 12, 13.

Electrolytic capacitors $C_{F1}$ and $C_{F2}$ in series connection are connected to both ends of the power supply terminals V+ and V− of each of the IPM modules 60*a* and 60*b*, and the DC voltage Vdc is applied thereto. Each of output terminals U1, V1, W1 of the IPM module 60*a* is connected to one end of each of the capacitors 24*a*, 25*a*, 26*a*, the other end thereof is connected to one end of each of the induction heating coils 11, 12, 13 and one end of each of the capacitors 24*b*, 25*b*, 26*b*, the other end of each of the induction heating coils 11, 12, 13 is connected to one end of each of the capacitors 29, 28, 27, the other end thereof is collectively connected to a connection point P of the electrolytic capacitors $C_{F1}$ and $C_{F2}$. In addition, the other end of each of the capacitors 24*b*, 25*b*, 26*b* is connected to each of output terminals U2, V2, W2 of the IPM module 60*b*.

According to the induction heating device 102 of the present embodiment, as the output powers of the respective inverters using the IPM module 60*a* and 60*b* are added, it is possible to increase an output.

Fourth Embodiment

The first embodiment has only the electrolytic capacitor $C_{F1}$ connected on the power supply side of the inverter, but in order to prevent higher order current components from refluxing to the power supply side, a low-pass filter may be provided for each of the inverters.

Figure 12:
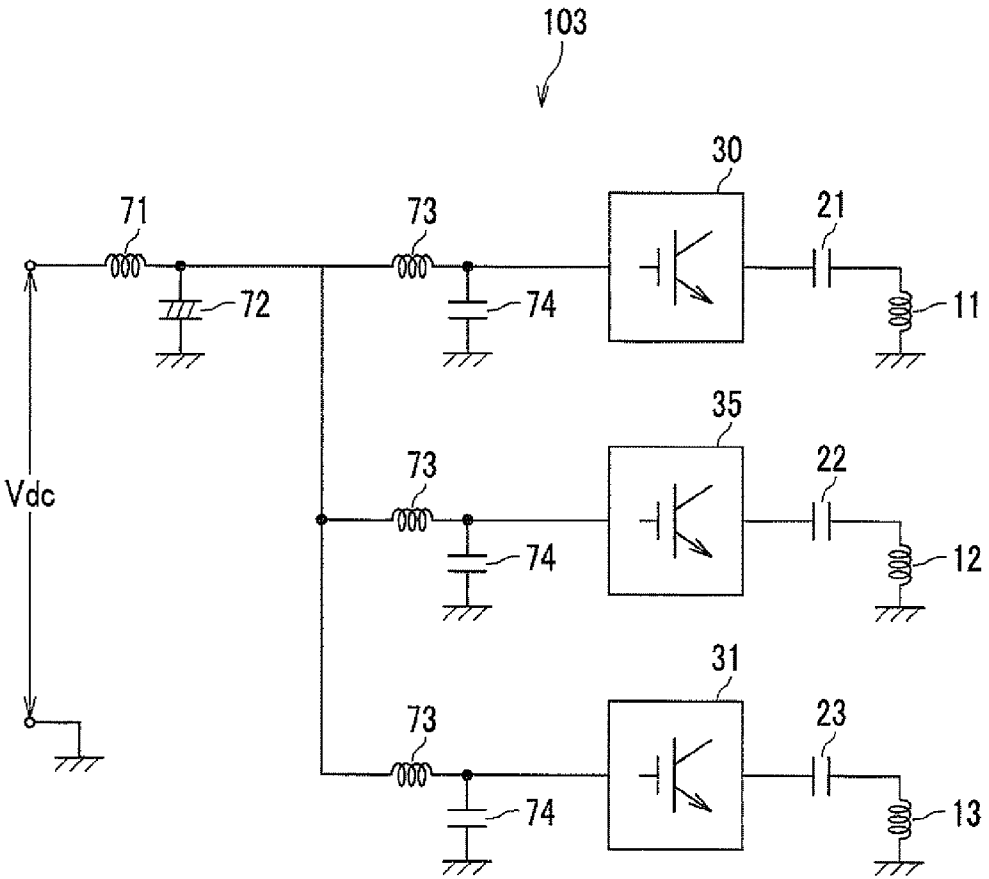
FIG. 12 is a circuit diagram of a fourth embodiment using higher order resonance prevention reactors.

FIG. 12 is a circuit diagram of a fourth embodiment using high-order resonance prevention reactors.

Similar to the first embodiment, an induction heating device 103 includes inverters 30, 35, 31, capacitors 21, 22, 23, and induction heating coils 11, 12, 13, and further includes, on the power supply side of each of the inverters 30, 35, 31, high-order resonance reactor 73 and a capacitor 74 that constitute a LC low-pass filter, wherein one end of the each of the three high-order resonance reactors 73 is collectively connected to one end of an electrolytic capacitor 72, and one end of a choke coil 71. The other end of the choke coil 71 is applied with the DC voltage Vdc, while the other end of the electrolytic capacitor 72 and the other end of the capacitor 74 are grounded.

An inductance of the high-order resonance prevention reactor 73 is set so that, by adding to a wiring inductance (several μH), a resonance frequency f0 determined together with the capacitor 74 (i.e., 1000 μF) becomes lower than the high-order resonance frequency 2f0 of the mutual induction voltage Vm.

Thus, it is possible to prevent the component of the high-order resonance frequency 2f0 of the mutual induction voltage Vm from refluxing to the power supply side of each of the inverters 30, 35, 31.

Fifth Embodiment

According to the aforementioned embodiments, the control unit 50 makes the inverters 30, 35, 31 work as PWM resonance inverters in all zones (zones 1, 2, 3), where a square-wave voltage (high-frequency voltage) of the carrier frequency is PWM modulated with a sine wave of the operation frequency, and an equivalent sine wave is outputted. As a supplied power becomes large in zone 2 which is the center of the heating zones, it is possible for the control unit 50 to make the inverter 35 work as a current resonance type inverter that outputs a rectangular wave voltage having the operation frequency, thereby reducing loss (see Japan Patent Application Publication No. 2010-287447A).

That is, the control unit 50 controls the pulse width so that the inverter 35 is to be in the resonant current phase lag mode, in which the zero-cross timing at which a sine-wave current zero crosses from negative to positive lags behind the rising timing of the rectangular wave drive voltage. In this way, the reverse recovery loss of the commutation diode in the inverter 35 is prevented from occurring. Note that even in this case, the control unit 50 makes the inverters 30 and 31 work as PWM resonance inverters.

Figure 13:
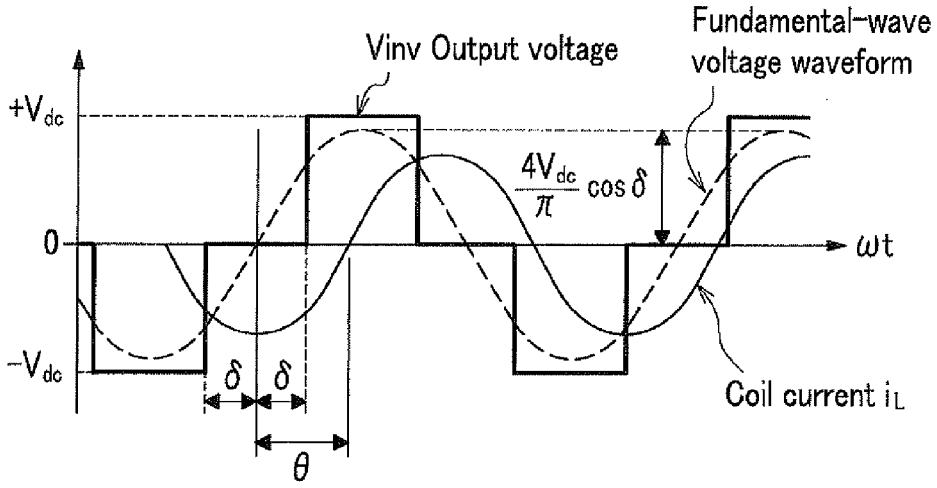
FIG. 13 is a waveform diagram for explaining an operation when using a rectangular wave voltage.

FIG. 13 is a waveform diagram for explaining the operation when using a rectangular wave voltage. This waveform diagram shows the output voltage Vinv (rectangular-wave voltage waveform) of the inverter 35, the fundamental-wave voltage waveform, and the coil current waveform, where the vertical axis represents a voltage and a current, and the horizontal axis represents a phase ($\omega t$). The output voltage Vinv of the inverter 35 is an odd function waveform (rectangular wave voltage waveforms), which is shown with a bold solid line and positive-negative symmetric, where the fundamental wave is shown as the fundamental wave voltage waveform, with a broken line. The output voltage Vinv has a maximum amplitude of ±Vdc, and a phase angle of the control angle $\delta$ is set relative to the zero-crossing point of the fundamental-wave voltage waveform. That is, there is a phase difference of the control angle $\delta$ between each of the rising and falling timings of the output voltage Vinv of the inverter 35 and the zero-cross timing of the fundamental-wave voltage waveform. At this time, amplitude of the fundamental-wave voltage waveform is $(4Vdc/\pi)*\cos\delta$, and a frequency is the operation frequency (1 k Hz).

In addition, the coil current waveform $i_L$ shown with a broken line is a sine wave which lags behind the zero-cross timing of the fundamental-wave voltage waveform, by the phase difference $\theta$.

Modifications

The present invention is not intended to be limited to the above embodiments, and can be modified in various ways as follows.

(1) According to the first embodiment, the capacitors 24, 25, 26 are connected in series with the induction heating coils 11, 12, 13, respectively, but the induction heating coils 11 and 13 in zones 1 and 3 can be directly coupled without connecting the capacitors 24 and 26.

That is, as the supplied powers from zones 1 and 3 are small, it is possible for zones 1 and 3 to work as PWM non-resonance inverters by adding capacitors. It is because there is no need in zones 1 and 3 to decrease the output voltage Vinv, for decreasing the power factor or decreasing the required capacity of the inverters.

(2) According to the first embodiment, the inverters 30, 35, 31 are directly connected to respective series circuits of the capacitors 24, 25, 26 and the induction heating coils 11, 12, 13, but can be connected via matching transformers, respectively.

For example, if it is sufficient with the output voltage Vinv=200 Vac when the power supply voltage is 400 Vdc, it is effective in that the output current of the inverter can be reduced by the matching transformer.

(3) The aforementioned embodiments have been described regarding a circuit for supplying a power to the billet heater for baking a billet (FIG. 1), but it is possible to use a vertical furnace or a spiral coil in a pancake shape.

In case of the vertical furnace, as the lowermost zone where a temperature is easily decreased is set to have a maximum output, the subject for the minimum phase angle control is the lowermost zone. In upper zones, capacitances of capacitors are set so that the natural resonance points therein are lower than the natural resonance point of the lowermost zone.

In case of the spiral coil in a pancake shape, as the outermost zone becomes to have the maximum output, the outermost zone is made to be the subject for a constant phase angle control. Capacitances in other zones are set so as to have the natural resonance points lower than the natural resonance point of the outermost zone. Note that the operation frequency of the coil center (singularity) is set to 200 kHz, and that of other areas is set to 40 kHz.

(4) In case of the aforementioned embodiments, the metal billet is directly induction heated, but it is possible, by induction heating graphite as a non-magnetic material, to indirectly heat the semiconductor wafer or the like.

The minimum phase angle control is performed for the zone that gives a maximum output, and capacitances of the capacitors in other zones are set so that the natural resonance points become lower than the natural resonance point of the lowermost zone.

Indirect heating is utilized for heating a vertical graphite tube using solenoid coils, a disc shape graphite using pancake coils, or the like.

Note that it is preferable in the above case that a chopper and a resonance type inverter are used at a heating frequency of approximately 20 k Hz to 50 k Hz.

What is claimed is:

1. An induction heating device comprising:

a plurality of induction heating coils which are disposed adjacent to each other;

a plurality of capacitors connected in series to the plurality of the induction heating coils, respectively, to form series resonant circuits;

a plurality of inverters for converting a DC voltage into high frequency voltages, respectively, and applying the high frequency voltages to the series resonant circuits, respectively; and a control circuit configured to perform pulse width control of the high frequency voltages, as well as to control the plurality of the inverters so as to align phases of coil currents respectively flowing through the plurality of the induction heating coils, wherein the control circuit is configured to operate the plurality of the inverters with a same frequency and current synchronization, and to control a phase difference between a high frequency voltage generated from a specific inverter, which, compared to other inverters, supplies the maximum power to an associated induction heating coil, and a coil current that flows through an associated series resonant circuit so as to become the minimum phase angle, with which the high frequency voltage does not have a lagging phase at any frequency relative to the coil current, and wherein the DC voltage applied to the plurality of the inverters is set so that the high frequency voltages have greater values than respective mutual induction voltages caused by the induction heating coils adjacent to each other.

2. The induction heating device, according to claim 1, further comprising a converter that converts an AC voltage of a commercial power supply to a DC voltage, and applies the DC voltage to the plurality of the inverters as the DC power supply voltage, wherein, when each of the plurality of the inverters generates an equivalent sine-wave voltage which is pulse width controlled, each of the high frequency voltages is calculated by multiplying a value, which is obtained by dividing the DC power supply voltage by the square root of two, by a modulation factor, and wherein, when each of the plurality of the inverters performs a chopper control, each of the high frequency voltages is defined by multiplying the DC power supply voltage by a duty ratio.

3. The induction heating device, according to claim 1, wherein the control circuit is configured to control a phase difference between the high frequency voltage generated from each of one or more inverters, and the coil current that flows through an associated series resonant circuit so as to become the minimum phase angle.

4. The induction heating device, according to claim 1, wherein the control circuit is configured to control a phase difference between the high frequency voltage generated from the specific inverter, which outputs the maximum power, or each of the plurality of the inverters, and the coil current that flows through the associated series resonant circuit so as to become the minimum phase angle.

5. The induction heating device, according to claim 1, wherein the high frequency voltage is formed to a rectangular wave voltage, and wherein the phase difference is a difference of phase between a rising timing of the rectangular wave voltage and a zero-cross timing of the coil current.

6. An induction heating device, according to claim 1, wherein the high frequency voltage is an equivalent sine-wave voltage having a rectangular waveform, which is obtained by comparing a sine-wave signal and a triangular-wave signal, and the phase difference is a difference of phase between a zero-cross timing of the sine-wave signal and a zero-cross timing of the coil current.

7. The induction heating device, according to claim 6, wherein the zero-cross timing of the coil current lags behind the zero-cross timing of the sine-wave signal.

8. The induction heating device, according to claim 1, wherein the high frequency voltage is an equivalent sine-wave voltage having a rectangular waveform, a time-integrated value of which varies in sine-wave form, and the phase difference is a difference of phase between the zero-cross timing of the sine wave and the zero-cross timing of the coil current.

9. The induction heating device, according to claim 1, wherein the control circuit is configured to control the high frequency voltage such that it is larger than a sum of mutual induction voltages derived from resonant currents respectively flowing through the plurality of the induction heating coils which are disposed adjacent to each other.

10. A control program, to be executed by a computer in a control circuit of an induction heating device, the induction heating device comprising:

a plurality of induction heating coils which are disposed adjacent to each other;

a plurality of capacitors connected in series to the plurality of the induction heating coils, respectively, to form series resonant circuits; and a plurality of inverters for converting a DC voltage into high frequency voltages, respectively, and applying the high frequency voltages to the series resonant circuits, respectively, wherein the control program, when executed by the computer, causes the control circuit to:

perform pulse width control of the high frequency voltages, as well as control the plurality of the inverters so as to align phases of coil currents respectively flowing through the plurality of the induction heating coils;

set the DC voltage applied to the plurality of the inverters so that the high frequency voltages have greater values than respective mutual induction voltages caused by the induction heating coils adjacent to each other; and operate the plurality of the inverters with a same frequency and current synchronization, and control a phase difference between a high frequency voltage generated from a specific inverter, which, compared to other inverters, supplies the maximum power to an associated induction heating coil, and a coil current that flows through an associated series resonant circuit so as to become the minimum phase angle, with which the high frequency voltage does not have a lagging phase at any frequency relative to the coil current.

* * * * *